US008296041B2

(12) United States Patent
Yamamura et al.

(10) Patent No.: US 8,296,041 B2
(45) Date of Patent: Oct. 23, 2012

(54) CONTROL APPARATUS FOR VEHICLE

(75) Inventors: Masanori Yamamura, Nagoya (JP); Kenji Kawahara, Kariya (JP)

(73) Assignee: Denso Corporation, Kariya (JP)

( * ) Notice: Subject to any disclaimer, the term of this patent is extended or adjusted under 35 U.S.C. 154(b) by 236 days.

(21) Appl. No.: 12/789,729

(22) Filed: May 28, 2010

(65) Prior Publication Data

US 2010/0305838 A1 Dec. 2, 2010

(30) Foreign Application Priority Data

May 29, 2009 (JP) ..... 2009-131145

(51) Int. Cl.
*F02D 41/06* (2006.01)

(52) U.S. Cl. ..... 701/110; 701/113; 123/179.4

(58) Field of Classification Search ..... 701/110, 701/113; 123/179.3, 179.4, 320, 325, 179.14, 123/179.16, 179.17, 179.18
See application file for complete search history.

(56) References Cited

U.S. PATENT DOCUMENTS 6,898,505 B2 * 5/2005 Kadota et al. ..... 701/71
7,258,185 B2 * 8/2007 Ohno et al. ..... 180/197
2001/0025220 A1 9/2001 Kaneko et al.
2010/0222973 A1 * 9/2010 Senda et al. ..... 701/54

FOREIGN PATENT DOCUMENTS

| | | |
|---|---|---|
| JP | P2001-032734 A | 2/2001 |
| JP | 2001-234838 | 8/2001 |
| JP | 2002-242724 | 8/2002 |
| JP | P2006-200526 A | 8/2006 |
| JP | 2009-013816 | 1/2009 |

OTHER PUBLICATIONS

Japanese Office Action dated May 10, 2011, issued in corresponding Japanese Application No. 2009-131145 with English Translation.

* cited by examiner

*Primary Examiner* — Hai Huynh
(74) *Attorney, Agent, or Firm* — Nixon & Vanderhye P.C.

(57) ABSTRACT

A vehicle control apparatus is provided which is operative in an automatic engine stop mode to stop an engine automatically and in an engine restart mode to restart the engine automatically after the engine is stopped in the automatic engine stop mode so as to output a predetermined reference engine torque immediately after the engine is started. The vehicle control apparatus works to determine the travel performance of the vehicle required immediately after the engine has been restarted in the engine restart mode and control the torque outputted by the engine based on the determined travel performance so as to ensure the drivability of the vehicle after the engine is restarted automatically.

5 Claims, 6 Drawing Sheets

CONTROL APPARATUS FOR VEHICLE

CROSS REFERENCE TO RELATED DOCUMENT

The present application claims the benefit of priority of Japanese Patent Application No. 2009-131145 filed on May 29, 2009 the disclosure of which is incorporated herein by reference.

BACKGROUND OF THE INVENTION

1. Technical Field of the Invention

The present invention relates generally to a vehicle control apparatus designed to control an output of an engine mounted in a vehicle in order to ensure the drivability of the vehicle when the engine is restarted automatically.

2. Background Art

There are known engine control systems for automotive vehicles which are designed to perform the so-called idle stop function (also called an automatic engine start/restart function) to stop the engine automatically when the output of the engine is not required, e.g., the brake pedal has been depressed and restart the engine automatically when the engine output is requested, e.g., the accelerator pedal has been depressed. Japanese Patent First Publication No. 2002-242724 teaches an engine control system for vehicles which switches the degree of output torque of an internal combustion engine between when the engine is started in response to turning on of a key made by a vehicle driver and when the engine is started in an idle stop control mode. Specifically, the engine control system decreases the degree of output torque of the engine when the engine is restarted automatically in the idle stop control mode to be below that when the engine is started manually by the vehicle driver in order to minimize starting shock arising from high-rpm idling of the engine. Additionally, when the temperature of cooling water or coolant for the engine is below a given value or a charged state of a storage battery installed in the vehicle is below a given level, the engine control system also restricts or inhibits the decrease in output torque of the engine when restarted, thereby decreasing the starting shock arising from high-rpm idling of the engine and ensuring the stability in starting the engine.

The engine control system is, as described above, designed to ensure the stability in restarting the engine, but however, does not consider the drivability after the engine is restarted. Specifically, even when the decrease in output torque of the engine is restricted to ensure the stability in restarting the engine in the idle stop control mode in conditions where the engine does not start easily, it may result in a lack in output torque of the engine needed to meet requirements imposed by factors such as surrounding conditions of the vehicle or driver's intentions other than relating to the vehicle itself, which leads to the deterioration of the drivability.

SUMMARY OF THE INVENTION

It is therefore a principal object of the invention to avoid the disadvantages of the prior art.

It is another object of the invention to provide a control system for vehicles which is designed to ensure the drivability immediately after an engine is restarted automatically.

According to one aspect of the invention, there is provided a vehicle control apparatus which comprises: (a) a starter which works to start an engine mounted in a vehicle; and (b) a controller which is operative in an automatic engine stop mode to stop the engine automatically when a given automatic engine stop condition is encountered and in an engine restart mode to restart the engine through the starter when a given engine restart condition is countered after the engine is stopped in the automatic engine stop mode so as to output a predetermined reference engine torque immediately after the engine is started. The controller determines the travel performance of the vehicle required immediately after the engine has been restarted in the engine restart mode and increases the torque outputted by the engine to be greater than the reference engine torque based on the determined travel performance.

Usually, there is a high possibility that the vehicle is enabled to travel when it is required to restart the engine or immediately after the engine is restarted. It may be, however, difficult to move the vehicle quickly depending upon the surrounding condition of the vehicle or the intension of the driver and ensure the drivability of the vehicle immediately after the engine is restarted.

In order to alleviate the above problem, the vehicle control apparatus works to analyze the travel performance of the vehicle required immediately after the engine has been restarted automatically and increases the torque outputted by the engine based on the travel performance, thereby avoiding or minimizing a lack in engine torque arising from the travel performance of the vehicle required immediately after the engine is restarted and ensuring the drivability of the vehicle.

In the preferred mode of the invention, the controller works to control an output of the engine transmitted to the axel of the vehicle selectively to produce a first engine torque immediately after the engine is started by a manual operation made by a driver of the vehicle and to suppress or decrease the output of the engine to be produced immediately after the engine is started by the manual operation made by the driver so as to produce a second engine torque that is the reference engine torque and smaller than the first engine torque immediately after the engine is restarted in the engine restart mode. The controller increases the torque outputted by the engine more than the reference engine torque by controlling the output of the engine so as to decrease an amount by which the output of the engine is suppressed or so as to increase the reference engine torque based on the determined travel performance of the vehicle.

In order to ensure the stability in starting the engine through the driver's manual operation, the controller may increase the torque outputted by the engine temporarily above that when the engine is idling immediately after the engine is started. It is, however, advisable that the torque outputted by the engine be decreased below that produced when the engine has been started by the driver's manual operation in order to reduce the starting shock or engine noise immediately after the engine is restarted automatically. Such suppression of the engine torque may, however, result in a difficulty in moving the vehicle quickly depending upon the surrounding condition of the vehicle or the intension of the driver and ensure the drivability of the vehicle immediately after the engine is restarted.

Accordingly, the controller is designed to increase the torque outputted by the engine more than the reference engine torque by controlling the output of the engine so as to decrease an amount by which the output of the engine is suppressed or so as to increase the reference engine torque based on the determined travel performance of the vehicle.

The controller may monitor an inclination of a road surface on which the vehicle is standing as the travel performance of the vehicle required immediately after the engine has been restarted automatically. This avoids the roll back of the vehicle when the vehicle is started on an upslope.

The controller may also monitor the degree of request made by the driver to start moving the vehicle quickly as the travel performance of the vehicle required immediately after the engine has been restarted automatically. This ensures the drivability of the vehicle which meets the driver's request.

The controller may analyze an amount by which an accelerator pedal has been depressed by the driver to determine the degree of request by the driver to start moving the vehicle quickly.

The controller may monitor the degree of friction between the vehicle and a road surface on which the vehicle is now standing, that is, determine whether the road surface is slippery or not. If the road surface is found to be slippery, the controller may cancel the increasing of the torque outputted by the engine more than the reference engine torque, thus avoiding the slippage of the vehicle on the road.

The controller may be designed to actuate a brake of the vehicle when the vehicle has slipped during deceleration of the vehicle. The controller determines the degree of friction based on an operating condition of the brake actuated within a given period of time immediately before the vehicle is stopped.

According to the second aspect of the invention, there is provided a vehicle control apparatus which comprises; (a) a starter which works to start an engine mounted in a vehicle; and (b) a controller which is operative in an automatic engine stop mode to stop the engine automatically when a given automatic engine stop condition is encountered and in an engine restart mode to restart the engine through the starter when a given engine restart condition is countered after the engine is stopped in the automatic engine stop mode so as to output a predetermined reference engine torque immediately after the engine is started. The controller also works to control an output of the engine transmitted to the axel of the vehicle selectively to produce a first engine torque immediately after the engine is started by a manual operation made by a driver of the vehicle and to suppress the output of the engine to be produced immediately after the engine is started by the manual operation made by the driver to produce a second engine torque that is the reference engine torque and smaller than the first engine torque immediately after the engine is restarted in the engine restart mode. The controller determines the travel performance of the vehicle required immediately after the engine has been restarted and increases the torque outputted by the engine more than the reference engine torque by controlling the output of the engine so as to change an amount by which the output of the engine is suppressed or so as to increase the reference engine torque based on the determined travel performance of the vehicle.

In order to ensure the stability in starting the engine through the driver's manual operation, the controller may increase the torque outputted by the engine temporarily above that when the engine is idling immediately after the engine is started. It is however, advisable that the torque outputted by the engine be decreased below that produced when the engine has been started by the driver's manual operation in order to reduce the starting shock or engine noise immediately after the engine is restarted automatically. Such suppression of the engine torque may, however, result in a difficulty in moving the vehicle quickly depending upon the surrounding condition of the vehicle or the intension of the driver and ensure the drivability of the vehicle immediately after the engine is restarted. Accordingly, the controller is designed to increase the torque outputted by the engine more than the reference engine torque by controlling the output of the engine so as to change an amount by which the output of the engine is suppressed or so as to increase the reference engine torque based on the determined travel performance of the vehicle.

In the preferred mode of the invention, the controller monitors an inclination of a road surface on which the vehicle is standing as the travel performance of the vehicle required immediately after the engine has been restarted automatically.

The controller may monitor the degree of request made by the driver to start moving the vehicle quickly as the travel performance of the vehicle required immediately after the engine has been restarted automatically.

The controller may analyze an amount by which an accelerator pedal has been depressed by the driver to determine the degree of request by the driver to start moving the vehicle quickly.

The controller may monitor the degree of friction between the vehicle and a road surface on which the vehicle is now standing and cancels the increasing of the torque outputted by the engine more than the reference engine torque.

The controller may actuate a brake of the vehicle when the vehicle has slipped during deceleration of the vehicle, and wherein the controller determines the degree of friction based on an operating condition of the brake actuated within a given period of time immediately before the vehicle is stopped.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 3(*b*) is a time diagram which shows how to change a rise in torque outputted by an engine through control of the position of a throttle valve between when the engine is retarded automatically and when the engine is started manually;

DESCRIPTION OF THE PREFERRED EMBODIMENTS

Figure 1:
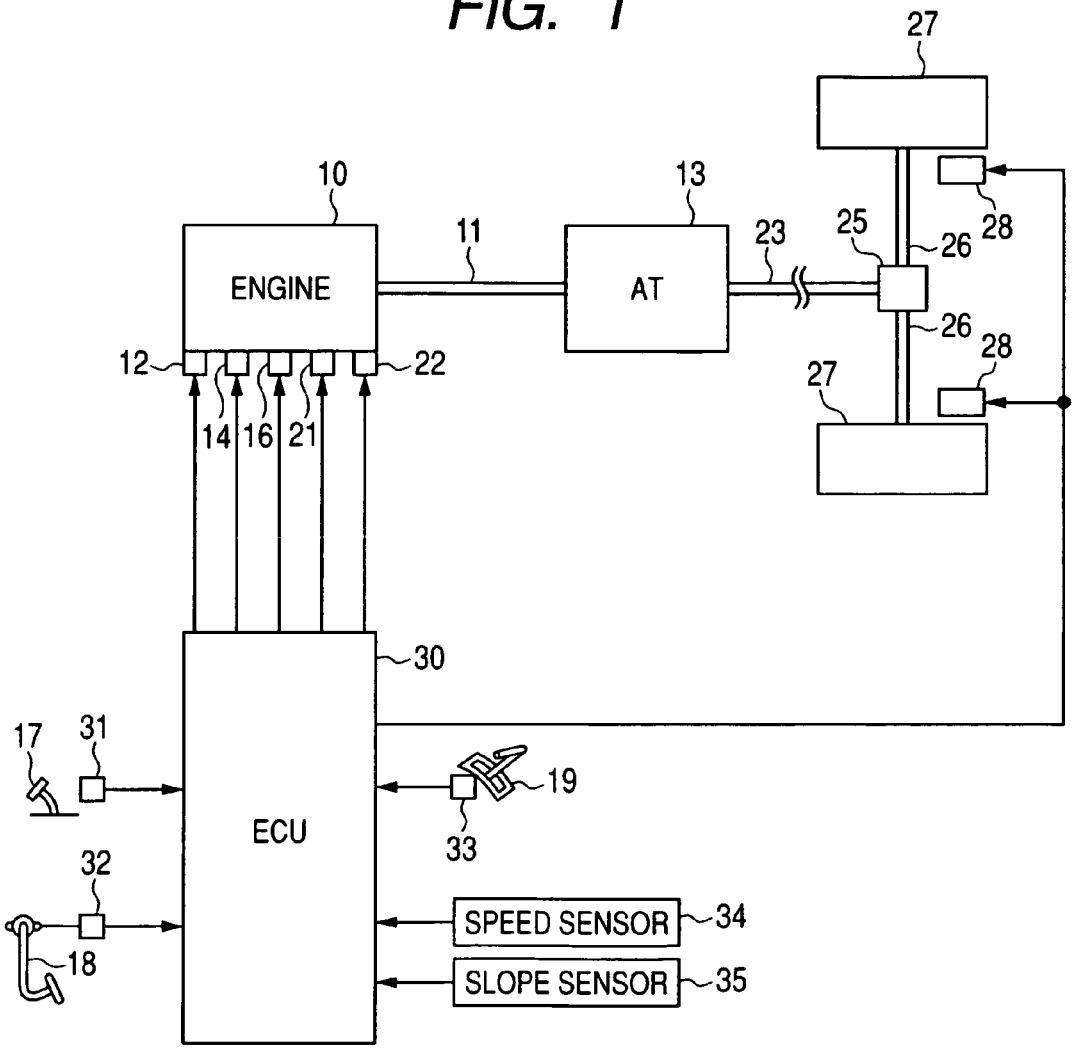
FIG. 1 is a block diagram which shows a vehicle control apparatus according to the present invention.

Referring to the drawings, particularly to FIG. 1, there is shown a vehicle control system according to the invention which is installed, as an example, in an automotive vehicle equipped with an internal combustion engine and an automatic speed variator.

The engine 10 is a multi-cylinder gasoline engine which is equipped with a throttle valve 12, injectors 14 one for each cylinder, an igniter, intake valves 21, and exhaust valves 22. The engine 10 is also equipped with a starter 16 which works to apply initial torque (i.e., cranking torque) to the engine 10 when it is required to start the engine 10.

The engine 10 has an output shaft 11 (i.e., a crankshaft) joined to an automatic transmission 13. The automatic transmission 13 is equipped with a torque converter and an automatic planetary gear transmission mechanism and works as the speed variator to change the rotational speed of the crankshaft 11 based on a currently selected gear ratio and transmit it to an output shaft 23. The automatic transmission 13 may alternatively be implemented by a belt-type continuously variable transmission (CVT) equipped with no torque converter.

The output shaft 23 of the transmission 13 is coupled to driven wheels 27 of the vehicle through a differential gear 25 and drive shafts 26. Each of the wheels 27 has a brake actuator 28 which is driven by a hydraulic circuit (not shown) to provide braking force to the driven wheel 27.

The vehicle control system also includes an electronic control unit (ECU) 30 equipped with a typical microcomputer. The ECU 30 monitors outputs of sensors installed in the vehicle control system to control an operation of the throttle valve 12 to regulate the amount of intake air, an operation of each of the injectors 14 to regulate the amount of fuel to be injected into the engine 10, an operation of the igniter to control the ignition of fuel in the engine 10, an operation of the engine 10, for example, in an idle stop control mode (also called an automatic engine stop/restart mode), an operation of the starter 16, and operations of the brake actuators 28. Specifically, the ECU 30 is connected to an accelerator sensor 31 (e.g., an acceleration stroke sensor), a brake sensor 32, a shift position sensor 33, a vehicle speed sensor 34, and a slope sensor 35. The accelerator sensor 31 measures a driver's effort on or position of an accelerator pedal 17. The brake sensor 32 measures a driver's effort on or position of a brake pedal 18. The shift position sensor 33 measures the position of a shift lever 19 (also called a selector lever) indicating one of a drive (D) range, a parking (P) range, a neutral (N) range, etc., at which the shift lever 19 lies. The vehicle speed sensor 34 measure the speed of the vehicle. The slope sensor 35 measures the inclination of a road surface on which the vehicle is now traveling or parked. These sensors provide outputs to the ECU 30 at all the time. The vehicle control system also includes an engine speed sensor, an engine load sensor such as an airflow meter or an intake air pressure sensor, and wheel speed sensors which measure speeds of the wheels 27.

The vehicle control system is also equipped with an antilock brake control system (ABS) which controls the slippage of the wheels 27 during deceleration of the vehicle. Specifically, the ABS determines the slip ratio of each of the wheels 27 based on the speed of the wheel 27, as measured by the wheel speed sensor, and the speed of the vehicle, as measured by the vehicle speed sensor 34. When the slip ratio exceeds a given upper limit, the ABS determines that the wheel 27 is slipping and outputs a control signal to a corresponding one of the brake actuators 28 to control the braking force exerted on the wheel 27.

The vehicle control system is, as described above, designed to perform the idle stop control in a known manner. Specifically, when a given automatic engine stop condition is encountered during an idle mode of the operation of the engine 10, the vehicle control system stops the engine 10 automatically. Afterwards, when a given engine restart condition is encountered, the vehicle control system restarts the engine 10 through the starter 16. For example, when at least one of conditions that the accelerator pedal 17 is released fully, so that the engine 10 is in the idle mode, that the brake pedal 18 is depressed, and that the speed of the vehicle is lower than a given value is met, the vehicle control system stops the engine 10. When at least one of conditions that the accelerator pedal 17 is depressed, and that the brake pedal 18 is released fully is met, the vehicle control system restarts the engine 10. In this embodiment, when the accelerator pedal 17 is depressed, the brake pedal 18 is released, and the shift lever 19 has been shifted to the D range, the vehicle control system restarts the engine 10.

In the fuel injection quantity control mode, the ECU 30 calculates a basic injection quantity based on operating conditions of the engine 10 such as an engine load and an engine speed and corrects the basic injection quantity in a way, as described below, to determine a target quantity of fuel to be injected into the engine 10. For example, when the engine 10 has been started, the ECU 30 increases the basic injection quantity. When it is required to accelerate the engine 10, the ECU 30 increases the basic injection quantity. The ECU 30 also increases the basic injection quantity as a function of the temperature of the intake air.

Specifically, when the engine 10 has been started, the ECU 30 increases the basic injection quantity so that the engine 10 produces the torque temporarily immediately after the start of the engine 10 which is greater in degree than that when the engine 10 is idling in order to ensure the stability in starting the engine 10 and make the driver acoustically perceive the fact that the engine 10 has been started.

Figure 2:
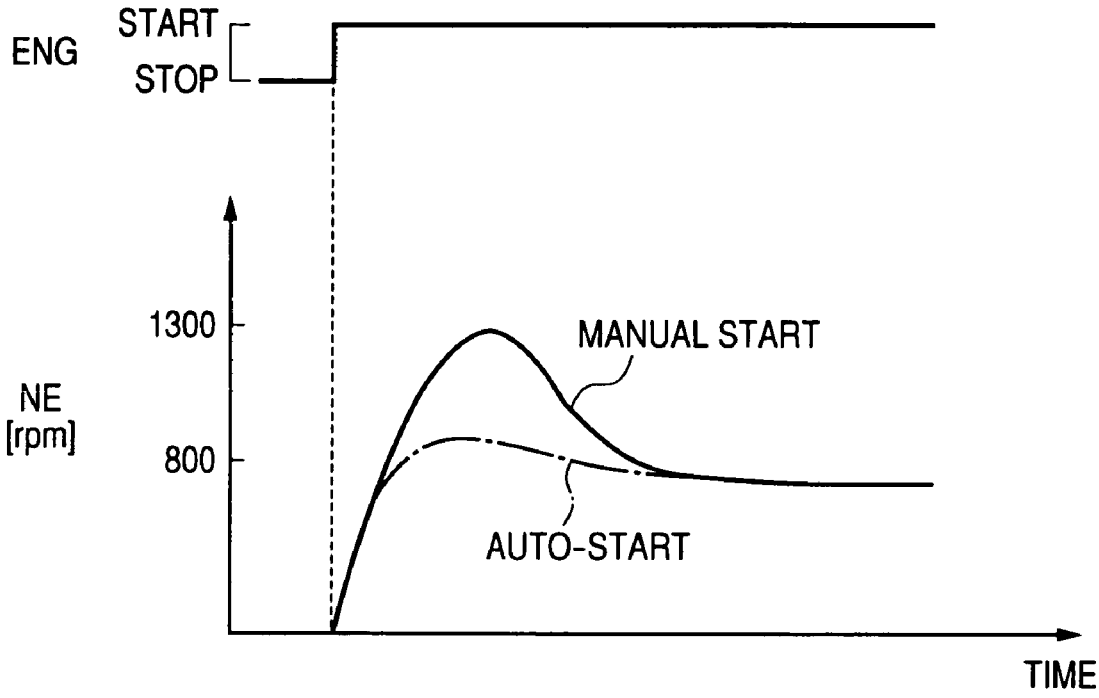
FIG. 2 is a time diagram which demonstrates a change in engine speed between when an engine is started manually and when the engine is restarted automatically.

FIG. 2 is a time diagram which demonstrates a change in engine speed NE when the engine 10 has been started. When a request has been issued by a key operation made by the driver to start the engine 10, the ECU 30 controls the injection quantity and the ignition timing to increase, as illustrated by a solid line in the drawing, the speed of the engine 10 temporarily up to, for example, 1000 to 1300 rpm. After the speed of the engine 10 is elevated temporarily, the ECU 30 decreases the torque, as outputted by the engine 10, gradually so as to avoid the stall of the engine 10 and finally keeps the speed of the engine 10 below an idle speed (e.g., 800 rpm). In other words, the ECU 30 controls the operation of the engine 10 so as to produce the peak of engine torque after the start of the engine 10, before the speed of the engine 10 is placed at the idle speed. This ensures the stability in starting the engine 10 and also makes the driver perceive that the engine 10 has been started through the engine noise.

The above instantaneous rise in speed of the engine 10 immediately after the restart of the engine 10 in the idle stop control mode may, however, lead to a concern about the deterioration in drivability of the vehicle. Specifically, when the shift lever 19 is in the forward speed range (e.g., the D range), and the engine 10 is restarted, it will cause the torque of the engine 10 which has been increased by the above rise in speed of the engine 10 made by the increase in quantity of fuel injected into the engine 10 to be transmitted from the crankshaft 11 joined to the drive shafts 26 through the automatic transmission 13 to the wheels 26, thereby resulting in a sudden rise in torque of the engine 10 which exerts an uncomfortable shock on the driver. Additionally, the engine noise is increased upon the restart of the engine 10, which gives an unpleasant feeling to the driver.

In order to alleviate the above problem, the vehicle control system of this embodiment is designed to change the torque outputted by the engine 10 between when the engine 10 has been started by the key operation of the driver and when the engine restart conditions have been met in the idle stop control mode, and the engine 10 has been restarted automatically. Specifically, when the driver of the vehicle has turned on the ignition key to start the engine 10, the ECU 30 then increases the speed of the engine 10, as indicated by the solid line in FIG. 2, to be above the idle speed to produce the peak of torque outputted by the engine 10. Alternatively, when the engine has been restarted automatically in the idle stop control mode, the ECU 30 controls the speed of the engine 10, as indicated by the chain line, without increasing it greatly instantaneously so as to produce the torque of the engine 10 which is lower than that produced immediately after the engine 10 is started manually, in other words, so as to decrease or eliminate the peak of the torque of the engine 10.

The above decreasing of the torque of the engine 10 may be achieved in several ways of:

1) closing or decreasing the degree of opening of the throttle valve 12 to decrease the quantity of fuel to be sprayed into the engine 10;

2) retarding the ignition timing in the igniter;

3) retarding the timing when the intake valves 21 are to be closed; and 4) increasing an electric load on an alternator installed in the vehicle.

Figure 3A:
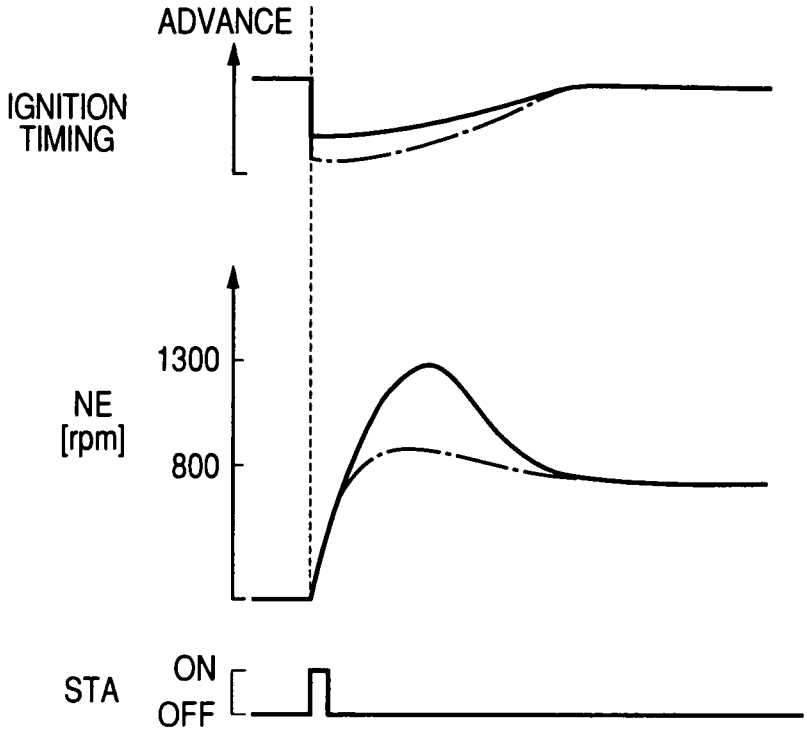
FIG. 3(*a*) is a time diagram which shows how to change a rise in torque outputted by an engine through control of the ignition timing between when the engine is retarded automatically and when the engine is started manually.
Figure 3B:
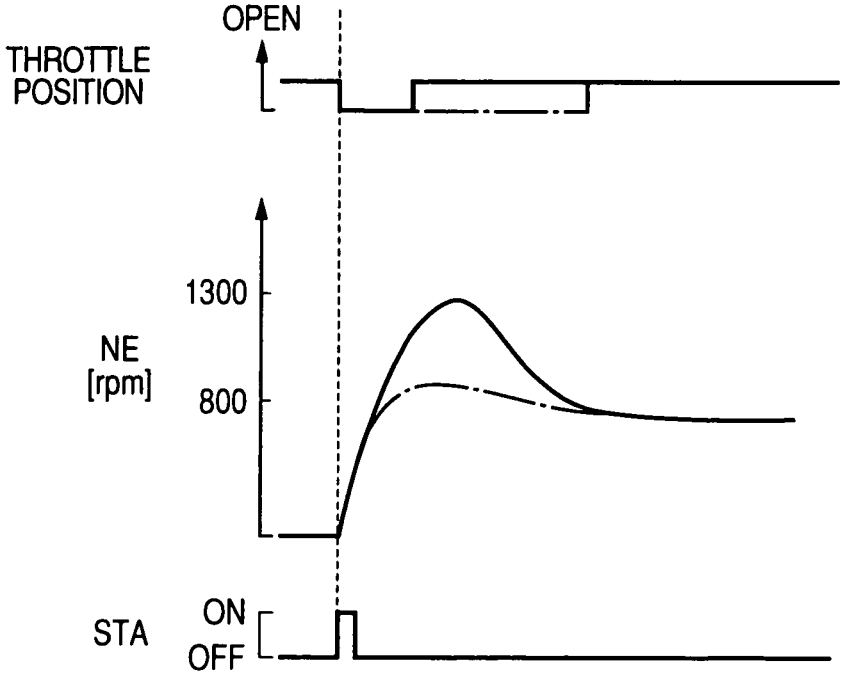

FIGS. 3(*a*) and 3(*b*) illustrate the rise in speed NE of the engine 10 achieved by controlling the ignition timing and the degree of opening of the throttle valve 12, respectively, immediately after the engine 10 is started. Solid lines represent the case where the engine 10 has been started by the manual key operation made by the driver of the vehicle. Chain lines represent the case where the engine 10 has been restarted automatically in the idle stop control mode.

In FIG. 3(*a*), when a request is made to restart the engine 10 automatically, the ECU 30 turns on the starter 16 to give an initial torque to the engine 10 and starts to spray the fuel into the engine 10 and ignite it. The ECU 30 shifts the ignition timing to the retarded side from a preselected start timing (e.g., a most advanced timing) and then returns it gradually to the advanced side. When the engine has been started by the manual key operation, the ECU 30 controls the torque to be outputted from the engine 10 so that the speed NE of the engine 10 is, as indicated by the solid line in FIG. 3(*a*), increased up to, for example, 1300 rpm and then kept finally at an idle speed (e.g., 800 rpm). Alternatively, when the engine has been restarted automatically in the idle stop control mode, the ECU 30 retards the ignition timing when the fuel is to be ignited in the engine 10 behind that when the engine 10 is started by the manual key operation, thereby lowering the torque outputted by the engine 10, as indicated by the chain line, as compared with that immediately after the engine 10 is started manually. Specifically, the ECU 30 controls the torque to be outputted by the engine 10 so as to keep the speed NE of the engine 10 below a given value (e.g., 800 rpm to 900 rpm) which is higher than the idle speed.

In FIG. 3(*b*), when a request has been made to restart the engine 10, the ECU 30 closes the throttle valve 12 so as to consume air in a surge tank installed in an intake air passage leading to the engine 10 and then opens the throttle valve 12. When the engine has been restarted in the idle stop control mode, the ECU 30 retards, as indicated by the chain line, the timing when the throttle valve 12 is to be opened behind that, as indicated by the solid line, when the engine has been started by the manual key operation, thereby decreasing the amount of air to be sucked into the engine 10. This causes the instantaneous rise in speed NE of the engine 10 to be decreased as compared with when the engine 10 has been started by the manual key operation.

When the instantaneous rise in speed of the engine 10 is decreased or suppressed in the above manner as compared with when the engine 10 has been started manually, it enables the engine 10 to be restarted automatically, but however, may result in discomfort of the driver or deterioration of the drivability of the vehicle. For example, when the engine 10 is restarted automatically on an upslope, it may result in a lack in torque output of the engine 10 immediately after the restart of the engine 10 because the gravity acts on the vehicle in a direction opposite that in which the vehicle advances. Specifically, when the gravity acting on the vehicle in a retreat direction in which the vehicle is moved backward exceeds the force acting on the vehicle in a forward direction in which the vehicle travels (i.e., creeping force during idling of the engine 10), it will cause the vehicle to be rolled backward immediately after the engine 10 is started, thus resulting in deterioration of the drivability of the vehicle.

When the driver wants to start moving the vehicle immediately after the engine 10 is started, it is necessary for the engine 10 to output torque quickly which is great enough to meet such a driver's requirement. The suppression or decrease in rise in speed of the engine 10 immediately after the start of the engine 10 may, however, result in a lack in engine torque, which does not meet the driver's requirement to start moving the vehicle quickly.

In order to eliminate the above problem, the vehicle control system of this embodiment is designed to monitor the traveling performance of the vehicle required immediately after the engine 10 is restarted automatically, i.e., the inclination of a road surface on which the vehicle is standing and/or degree of request made by the driver to start moving the vehicle quickly and increase the torque to be outputted by the engine 10 immediately after the restart of the engine 10 to be above a reference torque that is the torque required for the engine 10 to be outputted immediately after the restart of the engine 10 without consideration of the traveling performance of the vehicle required immediately after the engine 10 is restarted. Specifically, when the vehicle is found to be standing on the upslope or the request has been made by the driver to start moving the vehicle immediately after the engine 10 is restarted, the ECU 30 cancels the suppression or decrease in instantaneous rise in speed of the engine 10 or decrease the amount by which the torque output of the engine 10 is to be lowered from the peak thereof to be produced when the engine 10 has been started by the manual key operation, thereby developing the peak of the torque outputted by the engine 10 immediately after the engine 10 is restarted. In other words, when the engine 10 has been restarted, the ECU 30 controls the operation of the engine 10 so as to produce the torque which is equal to, greater, or smaller in magnitude slightly than that when the engine 10 has been started by the manual key operation based on analysis of the traveling performance of the vehicle required immediately after the engine 10 is restarted.

The vehicle control system of this embodiment is also designed to inhibit the control of the suppression of the instantaneous rise in speed of the engine 10 when a given suppression control cancellation condition is encountered. In other words, the vehicle control system cancels the decrease in amount by which the instantaneous rise in speed or torque of the engine 10 is decreased as compared with that achieved immediately after the engine 10 is started manually. For example, when the road surface on which the vehicle is standing or parked is wet or icy or has a low coefficient of frictional resistance, the ECU 30 decreases the instantaneous rise in speed of the engine 10 in the manner, as described above, because the instantaneous increase in torque outputted by the engine 10 may result in slippage of the vehicle on the road.

The torque control made by the ECU 30 immediately after the engine 10 is started will be described below with reference to flowcharts in FIGS. 4 to 6.

Figure 4:
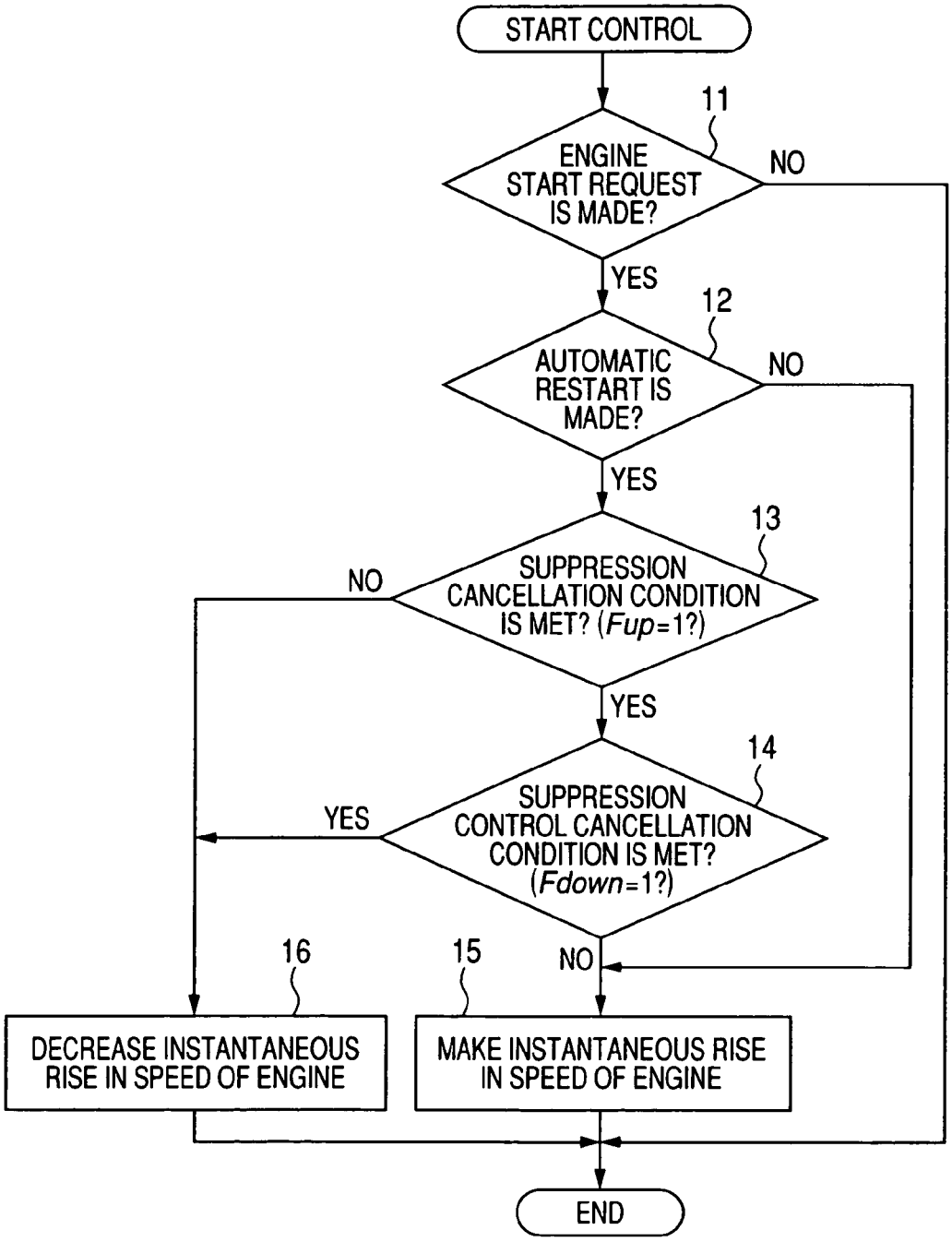
FIG. 4 is a flowchart of a program to be executed by the vehicle control apparatus of FIG. 1 to control an output of an engine selectively when the engine is started manually and automatically.

FIG. 4 is a sequence of logical steps or program to be executed by the ECU 30 at a given time interval to control the torque to be outputted by the engine 10 when started.

After entering the program, the routine proceeds to step 11 wherein it is determined whether a request to start the engine 10 has been made or not. If a YES answer is obtained meaning that the engine start request has been made, then the routine proceeds to step 12 wherein it is determined whether the engine start request in step 11 is an engine restart request or not which has been made when a given engine restart condition was encountered after the engine 10 was stopped. If a NO answer is obtained meaning that the engine start request has been made by the manual key operation of the driver of the vehicle, then the routine proceeds directly to step 15 wherein the instantaneous rise in speed of the engine 10 is made in the above manner immediately after the engine 10 is started, thereby ensuring the stability in operation of the engine 10 and also generating engine noise which is great enough to make the driver perceive acoustically the fact that the engine 10 has been started up.

If a YES answer is obtained in step 12 meaning that the engine 10 has been requested to be restarted automatically when the given engine restart condition has been encountered, then the routine proceeds to step 13 wherein it is determined whether either of suppression cancellation conditions is encountered or not. Specifically, a suppression cancellation flag Fup, as prepared in the flowchart of FIG. 5, is analyzed to determine whether either of the suppression cancellation conditions is met or not.

The suppression cancellation conditions are:

1) that the road on which the vehicle is now standing is an upslope whose inclination is greater than a given value; and 2) that the driver is showing an intention to start moving the vehicle quickly immediately after the engine 10 is started.

Figure 5:
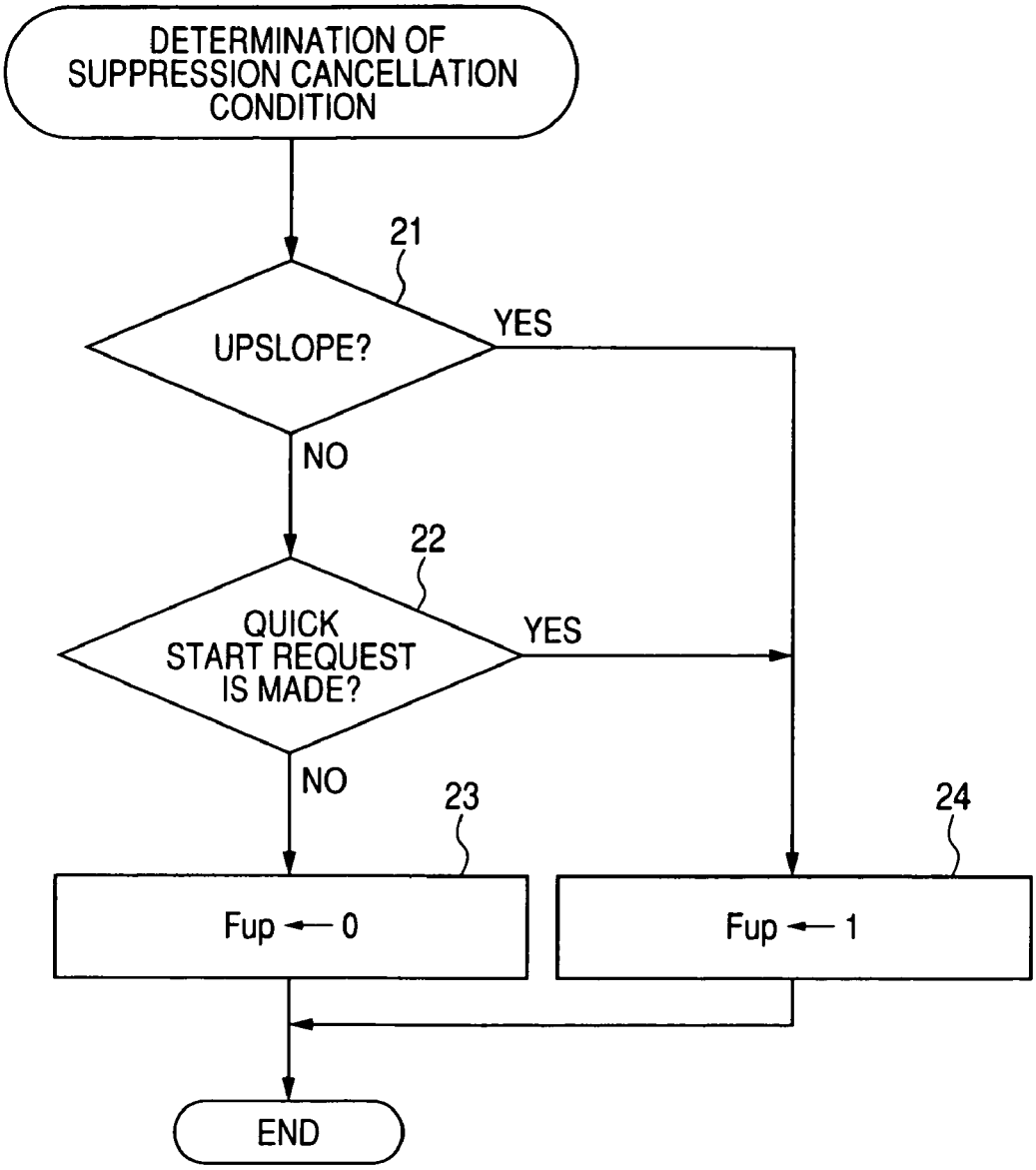
FIG. 5 is a flowchart of a sub-program to be executed along with that of FIG. 4 to determine whether an increase in engine torque should not be suppressed or not.

When one of the above suppression cancellation conditions is determined to be met in FIG. 5, the suppression cancellation flag Fup is set to one (1).

FIG. 5 is the program to be executed by the ECU 30 at a given time interval to determine whether either of the suppression cancellation conditions is met or not.

First, in step 21, it is determined whether the road on which the vehicle is now standing or parked is an upslope whose inclination is greater than the given value or not. Specifically, the ECU 30 monitors an output of the slope sensor 35 and determines a slope inclination SL. If the slope inclination SL is greater than the given value, then the routine proceeds to step 24. The slope inclination SL may alternatively be calculated based on an output of the vehicle speed sensor 34 or an acceleration sensor (not shown).

If a NO answer is obtained in step 21, then the routine proceeds to step 22 wherein it is determined whether a request has been made by the driver to start moving the vehicle quickly or not. The ECU 30 makes such a determination based on the driver's effort on the accelerator pedal 17. Specifically, when the accelerator pedal 17 is depressed by a given amount ATH or more within a preselected period of time (e.g., 0.5 sec. to 1 sec. usually consumed by the starter 16 to start the engine 10) after the engine restart request is made, the ECU 30 determines that the quick start request has been made by the driver.

The determination in step 22 may alternatively be made based on a rate at which the accelerator pedal 17 is depressed instead of the amount ATH.

If a NO answer is obtained in step 21 or 22, then the routine proceeds to step 23 wherein it is determined that neither of the suppression cancellation conditions is met, and the suppression cancellation flag Fup is set to zero (0). Alternatively, if a YES answer is obtained in step 21 or 22 meaning that either of the suppression cancellation conditions is encountered, then the routine proceeds to step 24 wherein the suppression cancellation flag Fup is set to one (1).

Referring back to FIG. 4, if the suppression cancellation flag Fup is set to zero (0), a NO answer is obtained in step 13. The routine then proceeds to step 16 wherein the instantaneous rise in speed of the engine 10 is decreased or suppressed in the manner, as described above, immediately after restart of the engine 10 in order to alleviate the starting shock. Specifically, the ECU 30 decreases the amount by which the torque to be outputted by the engine 10 is to be increased immediately after the engine 10 is started by the driver's manual key operation, in other words, controls the output of the engine 10 to produce the torque which is smaller in magnitude than that to be produced immediately after the start of the engine 10 by the driver's manual key operation.

Alternatively, if the suppression cancellation flag Fup is set to one (1), a YES answer is obtained in step 13. The routine then proceeds to step 14 wherein it is determined whether the suppression control cancellation condition is met or not which inhibits the suppression of the instantaneous rise in speed of the engine 10 from being controlled or eliminated, in other words, whether the control of an output of the engine 10 to produce the torque smaller in magnitude than that to be produced immediately after the engine 10 has been started by the driver's manual key operation should be performed is not. Specifically, such a determination is made by analyzing the status of a suppression control cancellation flag Fdown, as set in the flowchart of FIG. 6.

Figure 6:
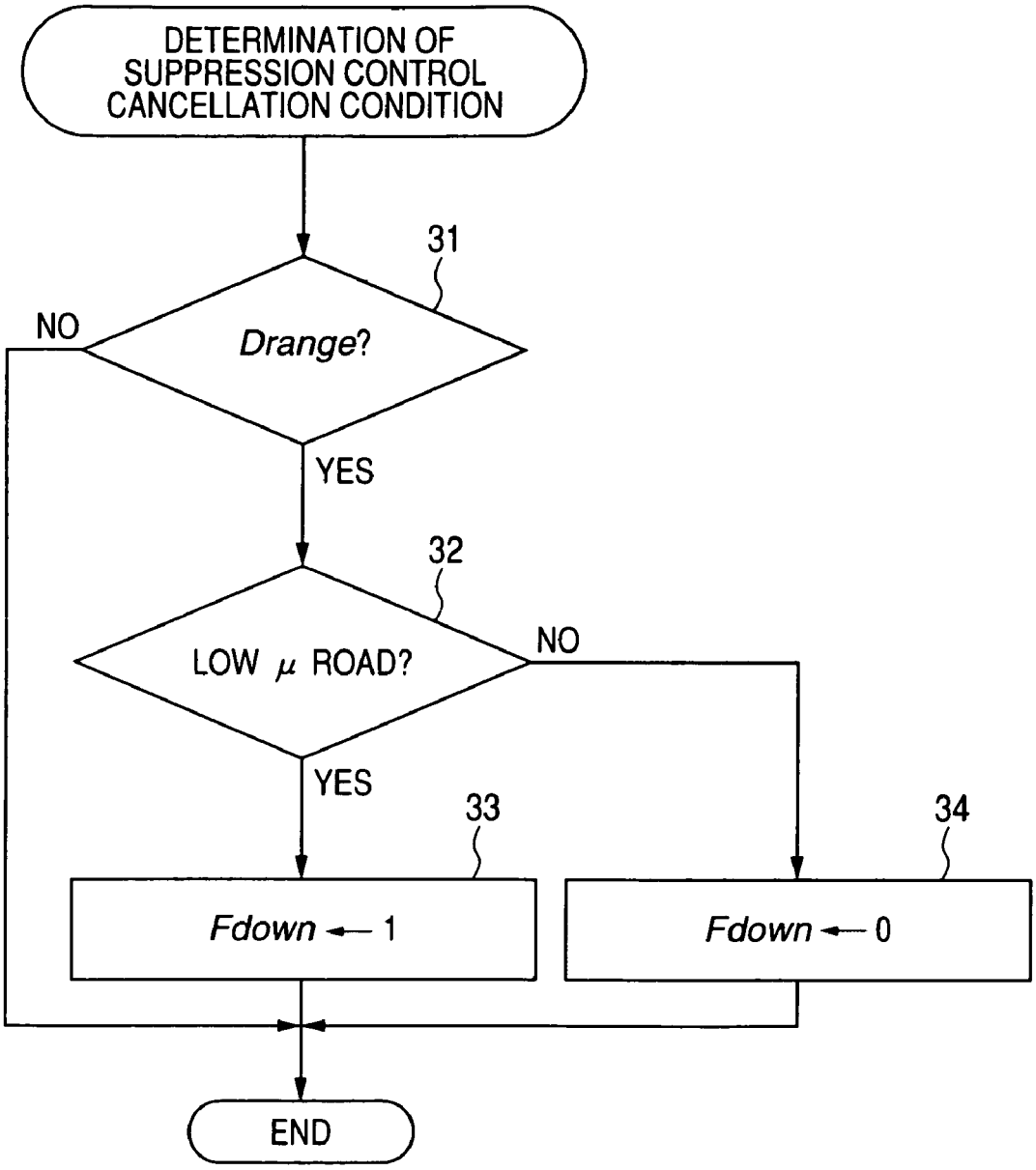
FIG. 6 is a flowchart of a sub-program to be executed along with that of FIG. 4 to determine whether an increase in engine torque should be suppressed or not.

FIG. 6 is the program to be executed by the ECU 30 at a given time interval to determine whether the suppression control cancellation condition is met or not.

First, in step 31, it is determined whether the position of the shift lever 19, as measured by the shift position sensor 33, is in the D range or not. If a YES answer is obtained meaning that the shift lever 19 is in the D range, then the routine proceeds to step 32 wherein it is determined whether the road on which the vehicle is standing or parked upon restart of the engine 10 is a low μ road (i.e., a slippery road) or not. If the brake actuator 28 was actuated in the ABS (Anti-Lock Brake System) mode within a given distance immediately before the engine 10 was stopped automatically in the idle stop control mode, it is determined that the road on which the vehicle is standing is slippery. The routine then proceeds to step 33 wherein the suppression control cancellation flag Fdown is set to one (1). Alternatively, if a NO answer is obtained in step 32 meaning that the road on which the vehicle is standing is not slippery, then the routine proceeds to step 34 wherein the suppression control cancellation flag Fdown is set to zero (0).

The determination of whether the road on which the vehicle is standing is slippery or not may alternatively be made as a function of an average slip ratio within a given distance immediately before the engine 10 is stopped automatically. The slip ratio is calculated based on a difference between the speed of the wheel 27, as measured by the wheel speed sensor, and the speed of the vehicle, as measured by the vehicle speed sensor 34. When the average value of the slip ratio in the given distance exceeds a preselected threshold value, the ECU 30 decides that the road on which the vehicle is standing is the low μ road. The threshold value may be determined to be either greater or smaller than a slip criterion used in the ABS.

Referring back to FIG. 4, if the suppression control cancellation flag Fdown is set to zero (0) meaning that the suppression control cancellation condition is not met, a NO answer is obtained in step 14. The routine then proceeds to step 15 wherein the instantaneous rise in speed of the engine 10 is achieved in the manner, as described above, immediately after the engine 10 is started. Specifically, when it is determined that it would be impossible for the vehicle to have the travel performance required immediately after the engine 10 is started, that is, that the road on which the vehicle is standing is an upslope whose inclination is greater than the given value or the amount by which the accelerator pedal 17 has been depressed is greater than the amount ATH, a lack in torque outputted by the engine 10 is considered to occur immediately after the engine 10 is started. In such a condition, the ECU 30 increases the torque outputted by the engine 10 immediately after the start of the engine 10 to provide the required travel performance.

The ECU 30 is, as described above, designed to change the amount by which the torque outputted by the engine 10 is to be increased instantaneously as a function of the slope inclination SL, as measured by the slope sensor 35, and the driver's effort on the accelerator pedal 17, as measured by the accelerator sensor 31. Specifically, the ECU 30 stores therein a map representing a relation among the slop inclination SL, the amount by which the accelerator pedal 17 is depressed, and the torque drop rate a that is a rate of engine torque to be decreased per amount by which the engine torque is to be increased when the engine 10 has been started by the driver's manual key operation (or the peak value of the engine torque) and selects a target value of the torque drop rate a from the map which corresponds to the slope inclination SL, as measured by the slope sensor 35, and the amount by which the accelerator pedal 17 is depressed, as measured by the accelerator sensor 31 to determine a target amount by which the engine torque is to be increased immediately after the current restart of the engine 10. The torque drop rate a, as stored in the map, has the value which is decreased with an increase in amount by which the accelerator pedal 17 is depressed. The torque drop rate a may have a negative (minus) value to increase the engine torque more than that when the instantaneous rise in torque of the engine 10 is not suppressed.

The instantaneous rise in torque of the engine 10 is so determined as to produce the creeping force which overcomes the gravity acting on the vehicle in a direction in which the vehicle is rolled backward on the slope. Specifically, the instantaneous rise in torque of the engine 10 is determined as a function of a difference between the speed of a turbine of the torque converter of the automatic transmission 13 and the speed of the engine 10. The amount by which the torque of the engine 10 is to be increased instantaneously may be equal to, greater, or smaller than that provided immediately after the engine 10 is started by the driver's manual key operation.

Referring back to FIG. 4, if the suppression control cancellation flag Fdown is set to one (1) meaning that the suppression control cancellation condition is met, a YES answer is obtained in step 14. The routine then proceeds to step 16 wherein the increase in speed or torque of the engine 10 is suppressed immediately after the engine 10 is restarted. When the shift lever 19 is in the D range, the rise in torque of the engine 10 will be transmitted to the drive shafts 26 through the automatic transmission 13. When the shift lever 19 is in the D range, and the road on which the vehicle is standing is slippery (i.e., the low μ road), the increase in torque of the engine 10 immediately after the restart of the engine 10 may result in slippage of the wheels 27. Therefore, when the road on which the vehicle is standing is slippery, and the shift lever 19 is in the D range, the ECU 30 cancels or suppresses the increase in torque of the engine 10 even though the vehicle is on the upslope or the amount by which the accelerator pedal 17 has been depressed is greater than the amount ATH.

The vehicle control system of this embodiment offers the following beneficial advantages.

The vehicle control system analyzes the travel performance of the vehicle required immediately after the engine 10 is restarted and increases the torque to be outputted by the engine 10 as needed to be above the reference torque that is the torque required for the engine 10 to be outputted when restarted without consideration of the traveling performance of the vehicle. This avoids a lack in torque outputted by the engine 10 immediately after the engine 10 is restarted and ensures the stability in traveling of the vehicle, that is, the drivability of the vehicle.

Usually, there is a high possibility that the shift lever 19 is already in the D range when it has been required to restart the engine 10 or will be shifted to the D range quickly immediately after the engine 10 is restarted. The surrounding condition of the vehicle or the intention of the driver, therefore, impinges upon the drivability of the vehicle more greatly than when the engine 10 has been started by the driver's manual key operation. The above consideration of the travel performance of the vehicle required immediately after the engine 10 is restarted in controlling the torque to be outputted by the engine 10 result in improvement of the drivability of the vehicle immediately after the engine 10 is restarted.

ECU 30, as described above, works to analyze the travel performance of the vehicle required immediately after the engine 10 is restarted to change the amount by which the instantaneous rise in torque to be outputted by the engine 10 in the case where the engine 10 has been started by the driver's manual key operation is to be controlled or suppressed, thereby avoiding an excessive decrease in engine torque in the condition where a lack in engine torque tends to occur. This ensures the stability in starting the vehicle as a function of the required travel performance of the vehicle.

Upon restart of the engine 10, the ECU 30 monitors the slope inclination SL as the travel performance required immediately after the engine 10 is restarted and determines the degree of torque to be outputted by the engine 10 which is great enough to overcome the force acting on the vehicle in a direction different from a forward travel direction of the vehicle based on the monitored slope inclination SL, thereby avoiding the roll back of the vehicle on the upslope when the vehicle is started.

Additionally, upon restart of the engine 10, the ECU 30 monitors the degree of request made by the driver to start moving the vehicle quickly as the travel performance required immediately after the engine 10 is restarted and determines the degree of torque to be outputted by the engine 10 based on the monitored degree of driver's request, thereby ensuring the stability in starting the vehicle quickly immediately after the engine has been restarted.

When the torque to be outputted by the engine 10 upon restart of the engine 10 is increased in terms of the required travel performance of the vehicle, the ECU 30, as described above, works to analyze the slop inclination SL and/or the degree of request made by the driver to start moving the vehicle quickly to change the amount by which the instantaneous rise in torque to be outputted by the engine 10 in the case where the engine 10 is started by the driver's manual key operation is to be suppressed, thereby avoiding an excessive decrease in engine torque in the condition where a lack in engine torque tends to occur.

The ECU 30 analyzes the degree of request made by the driver of the vehicle as a function of the driver's effort on the accelerator pedal 17, that is, the amount by which the accelerator pedal 17 has been depressed within a preselected period of time after the engine 10 is restarted, thereby ensuring the stability in starting the vehicle.

When the road on which the vehicle is now standing is found to be slippery, the ECU 30 cancels the increase in toque to be outputted by the engine 10 upon restart of the engine 10, thereby avoiding the slippage of the wheels 27 and ensuring the stability in starting the vehicle. Usually, if it is determined that the brake actuator 28 was actuated in the ABS mode, in other words, the wheels 27 slipped within a given distance immediately before the engine 10 was stopped automatically in the idle stop control mode, the ECU 30 decides that there is a high possibility that the wheels 27 will slip. The ECU 30, therefore, monitors whether the ABS has been actuated or not and determines whether the increase in engine torque upon restart of the engine 10 should be cancelled or not. This ensures the stability in starting the vehicle regardless of the condition of the road surface.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

For example, when the starter 16 has finished cranking the engine 10, and the ECU 30 is performing the control of the ignition timing or the degree of opening of the throttle valve 12 to alter the degree of torque outputted by the engine 10 upon restart thereof, and when the accelerator pedal 17 has been depressed over the given amount ATH, so that the request is found to have been made by the driver to start moving quickly, the ECU 30 may subsequently cancel the suppression of the instantaneous rise in torque to be outputted by the engine 10. For instance, at the time when the above conditions are found to be met, the ECU 30 may change the ignition timing to the advanced side to increase the torque to be outputted by the engine 10 temporarily. This control is performed between when the request is made by the driver to start moving the vehicle quickly and when the speed of the engine 10 is kept at the idle speed.

The ECU 30, as described above, works to control the suppression of the instantaneous rise in torque to be outputted by the engine 10 by changing the torque drop rate a that is a rate of engine torque to be decreased per amount by which the engine torque is to be increased temporarily when the engine 10 has been started by the driver's manual key operation as a function of the slope inclination SL and the amount by which the accelerator pedal 17 has been depressed, but however, may be designed to change the amount by which the engine torque is to be increased from a reference toque that is a target engine torque when the instantaneous rise in engine torque is to be suppressed or reduced upon restart of the engine 10 based on the slope inclination SL and the amount by which the accelerator pedal 17 has been depressed. The reference torque is the torque to be outputted by the engine 10 when the vehicle is on a flat and horizontal road surface, and the accelerator pedal 17 is not depressed, that is, kept released for a given period of time after the engine 10 is restarted.

The engine 10, as referred to above, is a port type fuel injection engine, but may be implemented by a direct-injection engine or a diesel engine. In this case, the instantaneous rise in torque to be outputted by the engine 10 may be suppressed or controlled by changing the injection timing when the injector 14 is to be opened to spray the fuel in the retarded side.

What is claimed is:

1. A vehicle control apparatus which is applied to a vehicle equipped with an automatic transmission which transmits an output of an engine to an axle and which stops said engine when a given automatic stop condition is encountered and restarts said engine when a given restart condition is encountered while the engine is being stopped automatically, comprising:

required travel performance detecting means for detecting a travel performance of the vehicle required immediately after restart of said engine;

torque controlling means for increasing torque of said engine when being restarted more than a reference torque based on a result of detection of said required travel performance detecting means;

braking means for actuating a brake when the vehicle slips while being decelerated; and friction condition detecting means for detecting a vehicle traveling road at a time of restart of the engine as being a low μ road when said braking means actuates the brake in a given period of time immediately before stop of the vehicle, characterized in that execution of torque control by said torque controlling means is stopped in a condition where said friction condition detecting means detects the vehicle traveling road at a time of restart of the engine as being the low μ road.

2. A vehicle control apparatus as set forth in claim 1, wherein said torque controlling means reduces a degree to which the torque of the engine when being restarted is suppressed relative to that of the engine when being restarted by a key operation of a driver or increases the torque more than when torque suppression is not executed, thereby increasing the torque of said engine when being restarted more than the reference torque.

3. A vehicle control apparatus as set forth in claim 1, wherein said required travel performance detecting means detects an inclination of the vehicle traveling road as the travel performance of the vehicle required immediately after the engine is restarted.

4. A vehicle control apparatus as set forth in claim 1, wherein said required travel performance detecting means detects a degree of request made by the driver to start the vehicle quickly as the travel performance of the vehicle required immediately after the engine is restarted.

5. A vehicle control apparatus as set forth in claim 4, wherein said required travel performance detecting means detects the degree of request by the driver to start the vehicle quickly based on a condition of an accelerator operation made by the driver.

* * * * *